United States Patent [19]

Salemme

[11] 3,934,628

[45] Jan. 27, 1976

[54] MECHANICAL APPARATUS FOR CUTTING MOVING WORK

[75] Inventor: Fred J. Salemme, Stockton, Calif.

[73] Assignee: California Cedar Products Company Inc., Stockton, Calif.

[22] Filed: Mar. 31, 1975

[21] Appl. No.: 563,803

[52] U.S. Cl. ..... 144/2 R; 83/308; 83/326

[51] Int. Cl.[2] ..... B27M 3/00; B26D 1/56

[58] Field of Search ..... 83/308, 326; 144/2 R

[56] References Cited

UNITED STATES PATENTS

| | | | |
|---|---|---|---|
| 3,557,651 | 1/1971 | Byrley | 83/308 X |
| 3,783,725 | 1/1974 | Payeur | 83/326 |
| 3,886,832 | 6/1975 | Harris | 83/326 X |

FOREIGN PATENTS OR APPLICATIONS

| | | | |
|---|---|---|---|
| 249,966 | 8/1912 | Germany | 83/326 |

*Primary Examiner*—Al Lawrence Smith
*Assistant Examiner*—Gary L. Smith

[57] ABSTRACT

A mechanical apparatus used to accurately cut extruded artifically made fire logs to a length determined by the distance between consecutive cutting blades suitably mounted on a rotating flexible force transmitting means, for example a pair of chains, is disclosed. This apparatus is entirely mechanical, deriving its power from the motion of the work to be cut. The apparatus is adjustable so as to accommodate chains of different lengths, each different length of chain produces a different length cut fire log.

10 Claims, 13 Drawing Figures

Fig. 3b
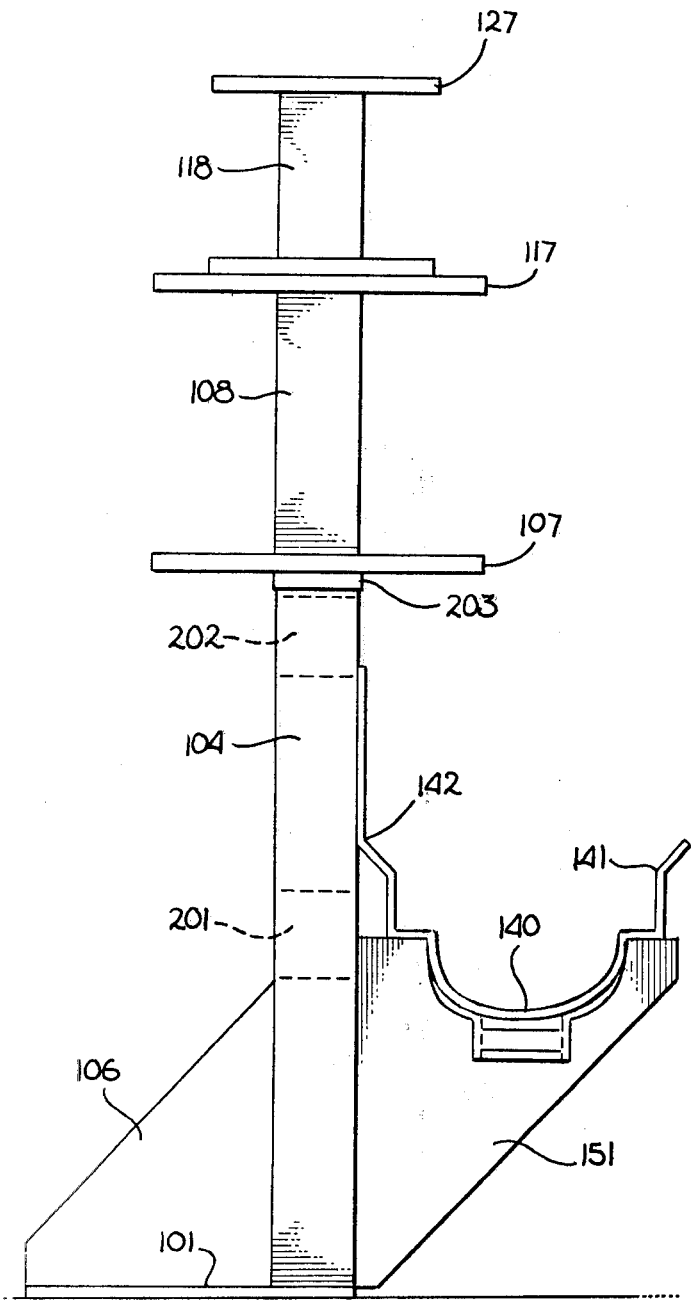
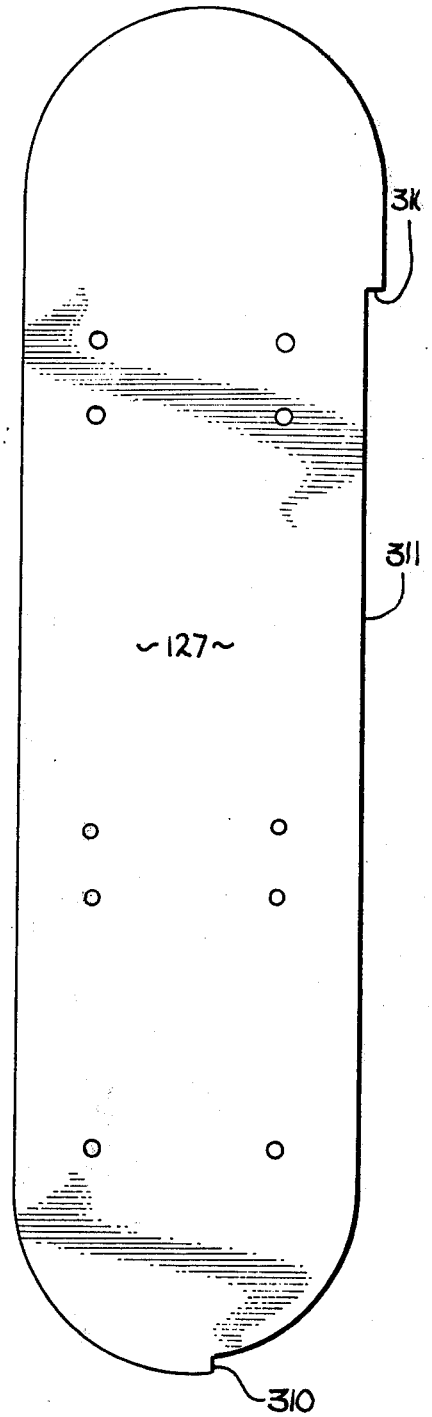
Fig. 4

Fig. 7
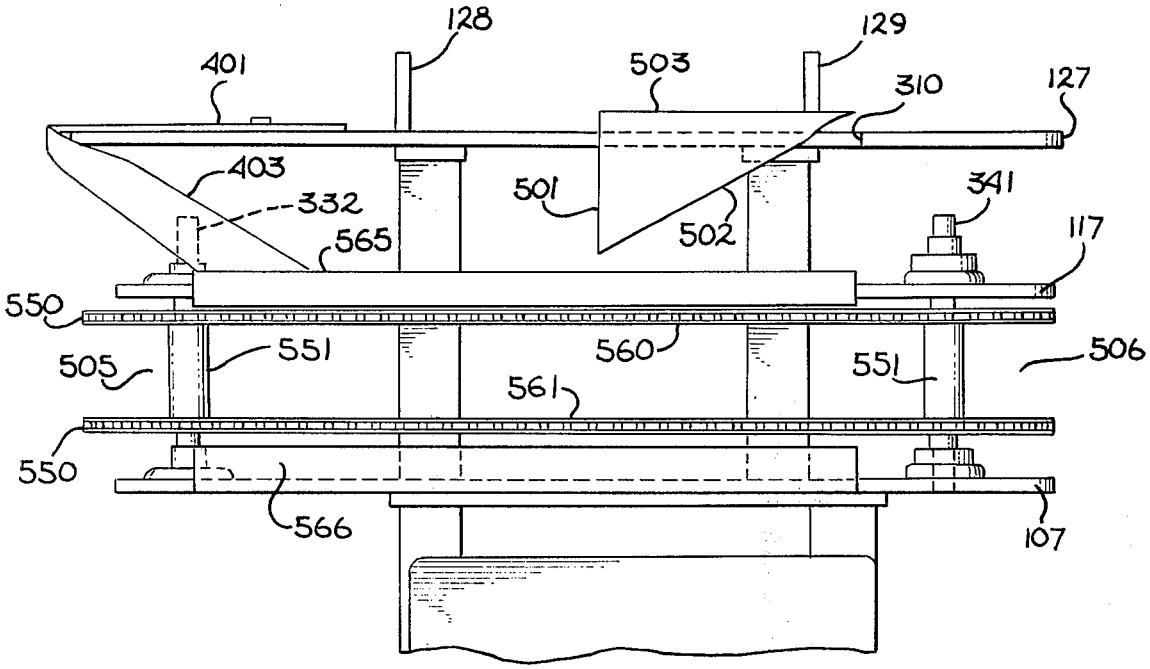
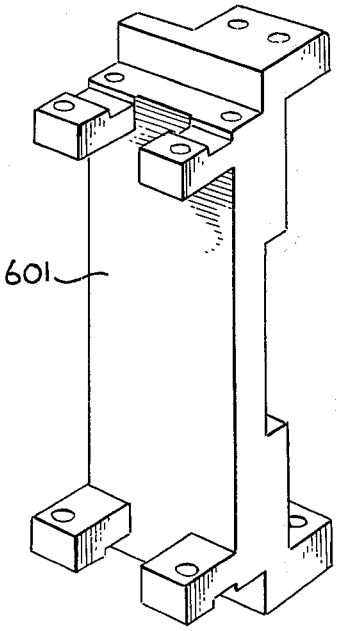
Fig. 8
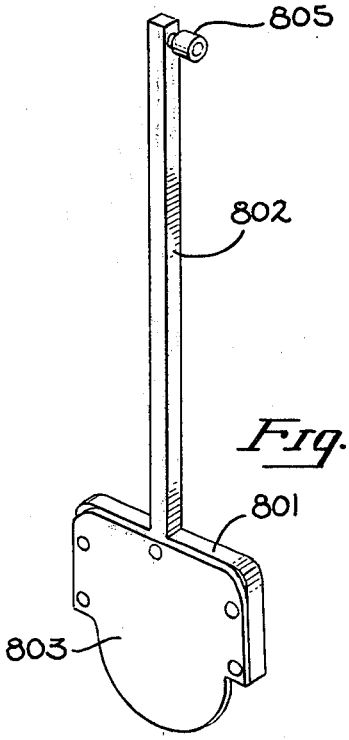
Fig. 9

Fig. 10
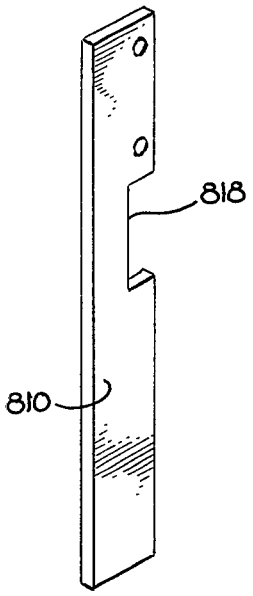
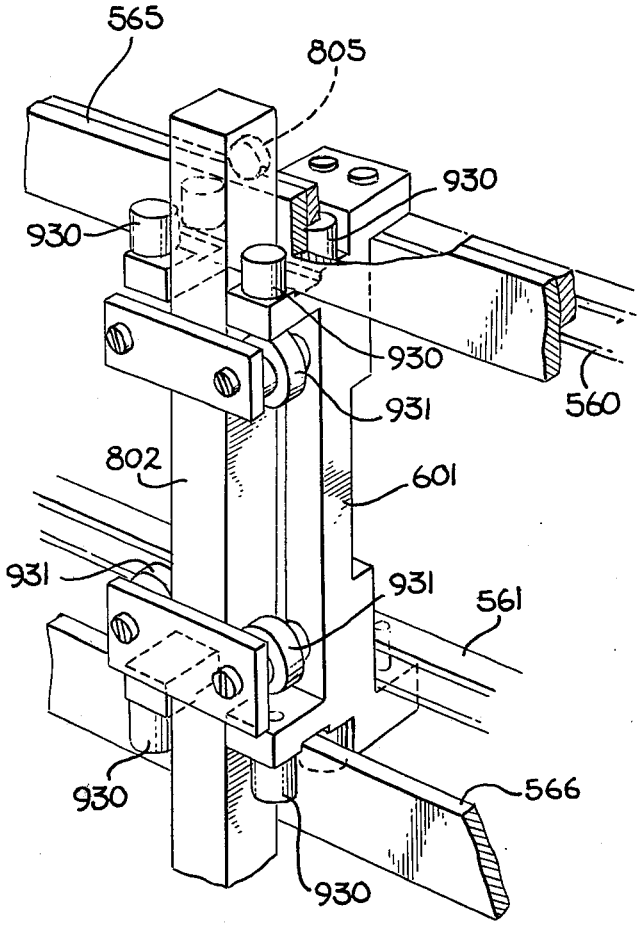
Fig. 11
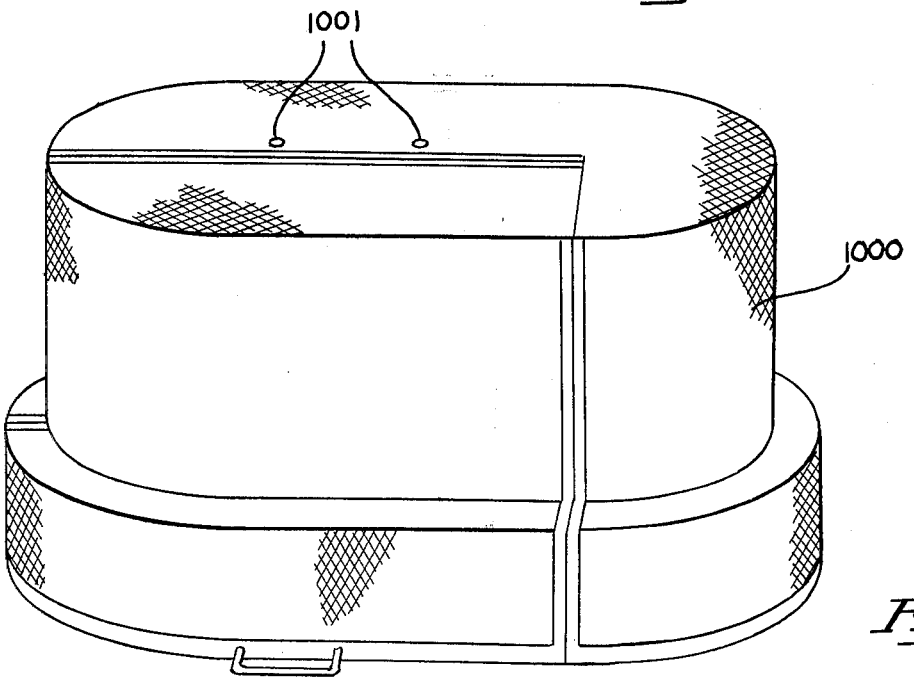
Fig. 12

MECHANICAL APPARATUS FOR CUTTING MOVING WORK

BACKGROUND OF THE INVENTION

1. Field of the Invention

This invention relates to that field of apparatus used to cut moving work to a specified length. More particularly this invention relates to mechanical apparatus, containing a plurality of cutting surfaces used to cut moving work to a specified length, which draws its cutting power from the moving work itself.

2. Description of the Prior Art

Prior art apparatus used to cut moving work of wood composition or similar material have required some external power source, typically compressed air, electricity, or hydraulic power or a combination of these sources of power. For example, the work to be cut would proceed along its path until it triggered a micro-switch which in turn would control the external power source which would supply power to a cutting device which in turn would operate to sever the work. Such machines have inherent time lags and mechanical delays, the micro-switch takes a certain time to respond, compressed air requires time to transmit force from one point to another and is very noisy, and time lag is necessary to change the flow of hydraulic fluids. Because of the various time lags of the prior art machines, which were independent of the speed at which the moving work was cut, the length to which the work would be cut was not uniform over various operating speeds of the cutting machine, was not easily adjusted and was not easily determined prior to operation. This lack of uniformity in the length to which the work was cut caused the manufacturer to set the machine to cut to a longer length than desired in order to insure that if somewhere along the line an abnormally short cut was made, the contents of a given package of the cut work would meet the minimum weight, length and burn time specified on the package. In many cases this resulted in the manufacturer giving more of the product to the consumer than required, resulting in increased production costs to the manufacturer per unit sold, an inefficient use of raw materials, and decreased profit margin.

The prior art use of an externally controlled power source required considerable maintenance of the relatively complicated electrical, hydraulic or pneumatic power mechanism, accounting for as much as 80% of the time during which production was halted for repairs and/or maintenance (down time) of the machinery. By not using such external power sources, the present invention significantly reduces this "down time".

BRIEF SUMMARY OF THE INVENTION

The invention disclosed herein is an apparatus used to cut moving work of wood composition or similar material. The typical wood composition consists of a mixture of sawdust and wax, approximately 60% wax and 40% wood sawdust by weight, depending on the desired burning and cutting characteristics. Generally the apparatus is set to cut logs to a length of 11½ to 14 inches. The cross sectional shape of the logs is presently that of an ellipse with its ends flattened, having a diameter of about 3 to 4 inches.

The invention cuts the moving work by means of a plurality of cutting knives, each individually mounted in a knife holder which is fastened at each end to one of two continuous rotatable chains. The two chains are of the same size and length and one chain is located directly beneath the other, separated by an appropriate distance which is typically about 4 inches. The knife holder is a single metallic machined piece, which spans this space between the chains, having one end affixed to the upper chain and the other end affixed to the lower chain. This knife holder is suitably formed so as to receive the knife and allow vertical movement of the knife with respect to the knife holder. The function of the knife holder and chains could also be served by a single device combining the features of the knife holder and chains. For example, a beltlike member with perforations along each edge could be fitted with mountings suitable to accommodate the knives.

At any give moment during the operation of this apparatus at least one knife is in contact with the moving work, and it is through this knife that power is supplied to the present invention apparatus. The moving work presses against a knife forcing it along its rotating path, the knife transmits this force through the knife holder to the chains. The chains transfer the power along the chains to the next knife holder and to its knife which has been pulled into position so that it is now ready to descend and cut the work. This process will become clear later in this disclosure.

Because the present invention apparatus or machine contains no micro-switch, relays, or external control and application of power to the cutting tool, it has none of the time lags associated with the prior art mechanisms discussed above. By use of this invention, the manufacturer can preset the length to which the work is to be cut and be assured that each succeeding cut will be exactly the same length even though the operating speed of the invention may vary over a wide range. This uniformity of length means the manufacturer no longer must be overly generous to the consumer in order to avoid shortweighting a package. Waste is reduced to a minimum, production costs per unit sold are reduced, and profits increased. Typically, a speed of 20 to 30 cuts per minute is used. As temperature increases the stiffness of the extruded log decreases since the wax softens. Up to a limit, increased temperature allows higher cutting rates, but if the temperature goes too high, the wax melts and the log disintegrates.

The objects of this invention are thus to provide an apparatus for cutting moving work which cuts to an accurate and consistent length over a wide range of operating speeds, is easily adjusted to cut work to various lengths, and requires little maintenance. It is desired that the apparatus not employ an external power source for cutting, but rather that it use the energy contained in the moving work itself to produce the necessary power. A further goal is to construct a machine having no time delays which are independent of the speed at which the machine is operated.

BRIEF DESCRIPTION OF THE DRAWINGS

For a more complete understanding of the present invention and for further objects and advantages thereof, reference is now made to the following description taken in conjunction with the accompanying drawings, in which:

FIG. 3*b* is an end plane view of the supportive framework;

FIG. 4 is a top plane view of the upper plate;

FIG. 7 is a front view of the apparatus without the knife holders and knives;

FIG. 8 is an isometric view of the knife holder;

FIG. 9 is an isometric view of the blade holder with a mounted blade;

FIG. 10 is an isometric view of the stripper;

FIG. 11 is an isometric view of a portion of the knife as mounted in the knife holder, showing the roller bearings;

FIG. 12 is a perspective view of the protective guard of the cutting apparatus.

DETAILED DESCRIPTION OF THE PREFERRED EMBODIMENT

Figure 1:
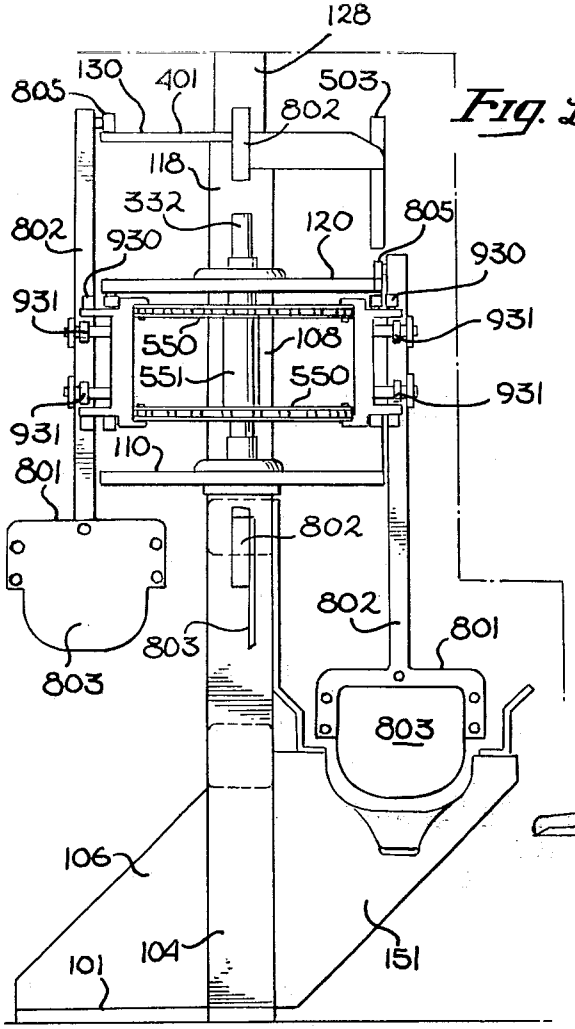
FIG. 1 is an end view of the fully assembled cutting apparatus, with its protective guard removed.

The invention illustrated in FIG. 1 is a mechanical apparatus used to cut moving work, consisting of a supportive framework, a work guide-tray also referred to as the trough, and the cutting mechanism. The invention uses the energy present in the moving work itself to drive the cutting apparatus and sever the moving work, no other source of power is necessary. The moving work is directed by means of the guide-tray so as to exert a force against the rear surface of a cutting blade, pushing the blade forward. This force is transmitted up the shaft of the blade holder, and through the knife holder to the flexible force transmitting means, typically a pair of chains, upon which the knife holder is mounted. The force causes the chains to rotate, which transmits the force along the chains to the knife immediately adjacent to and behind the first knife. The flexible force transmitting means pulls the second knife forward, that is, in the same direction as the work moves, unitl the roller bearing mounted near the top of the knife encounters the wedge plate guide means. The roller bearing is forced against the wedge plate guide means and forced to follow the edge of the wedge plate in a forward and downward direction. This causes the blade holder and blade to also follow a combined forward and downward path which results in the severance of the moving work which has been directed beneath the blade by the trough. This process can be better understood after a reading of the following detailed description of the elementary parts of the preferred embodiment.

Figure 2:
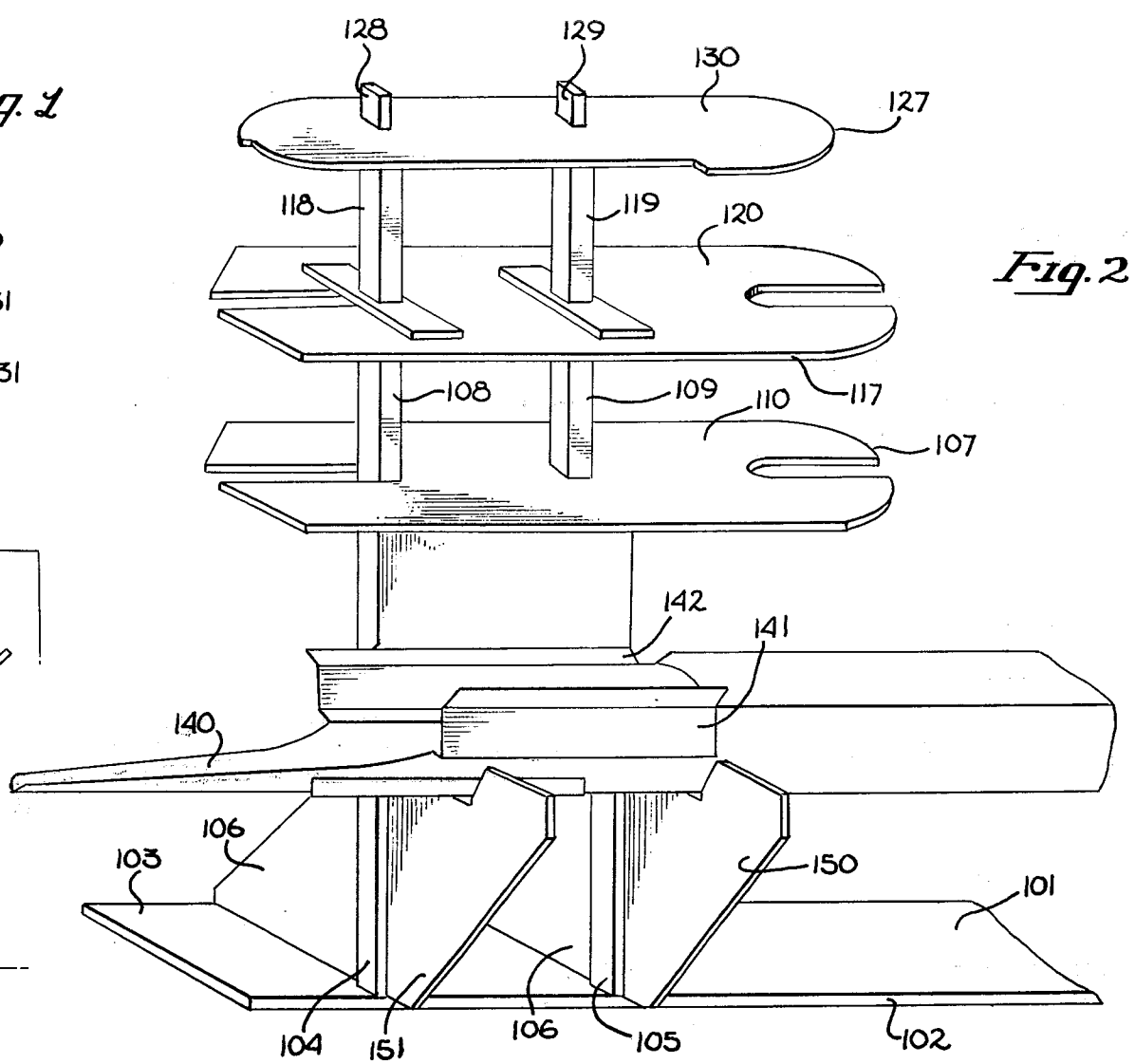
FIG. 2 is an isometric view of the supportive framework of the apparatus.
Figure 3A:
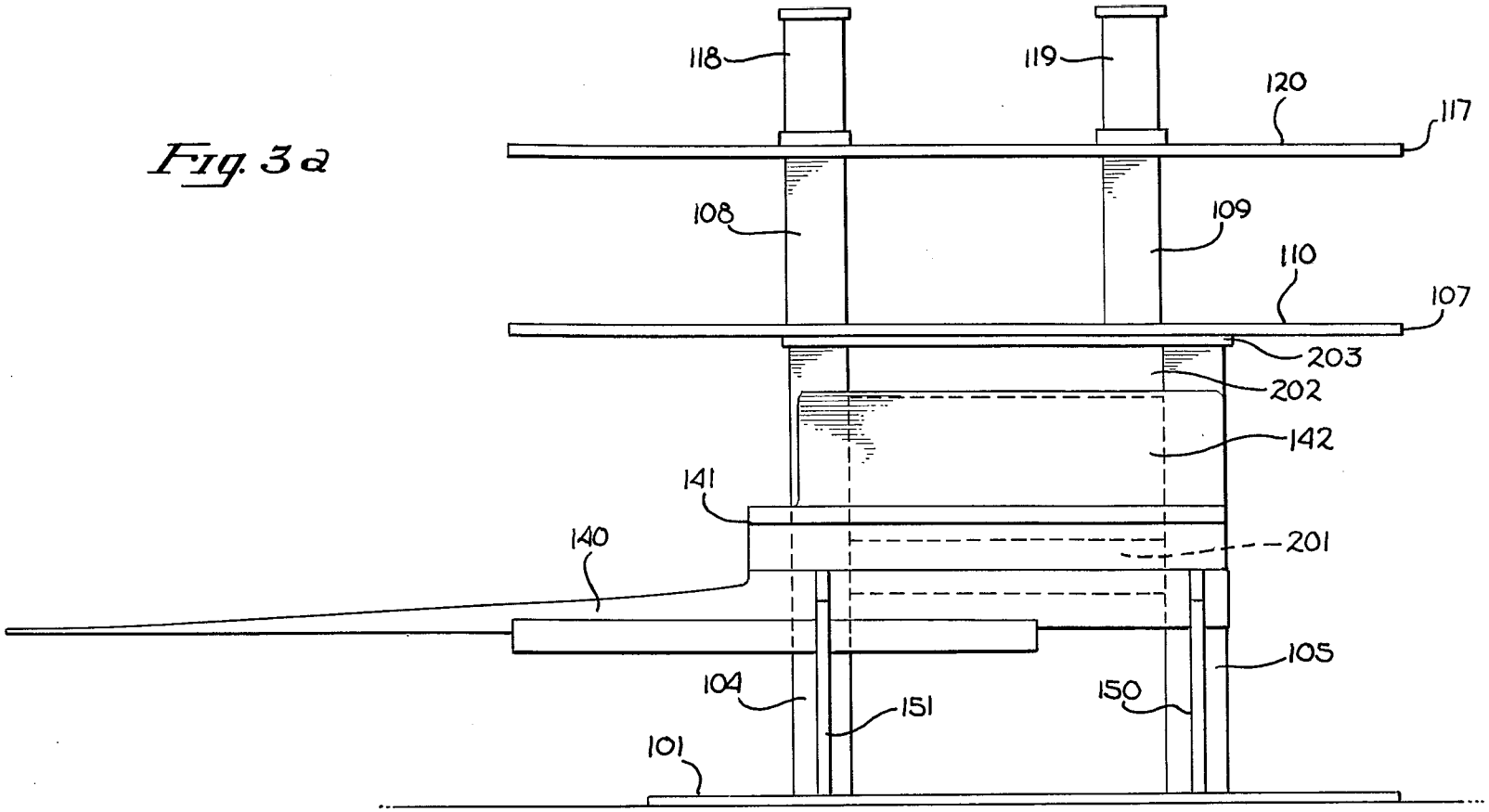
FIG. 3*a* is a front plane view of the supportive framework.

The description of the supportive framework of the cutting apparatus will be given with frequent references to parts shown in FIGS. 2, 3*a*, and 3*b*. FIG. 2 is an isometric view of the supportive framework and is used to present a three-dimensional view of the basic shape and spatial orientation of the elements of the framework.

The baseplate 101 is made of heavy gauge metal plate of a size sufficient to accommodate the remainder of the framework with room to allow for a means to anchor the baseplate 101 to a solid foundation (not shown). For convenience of description the baseplate will be referred to as having a front edge 102 and a rear edge 103 and the apparatus as a whole will have corresponding thereto a front side and a rear side. One end of each of at least two equally long vertically oriented structural beams 104 and 105 is rigidly affixed, by suitable means, to the upper surface of the baseplate

Figure 5:
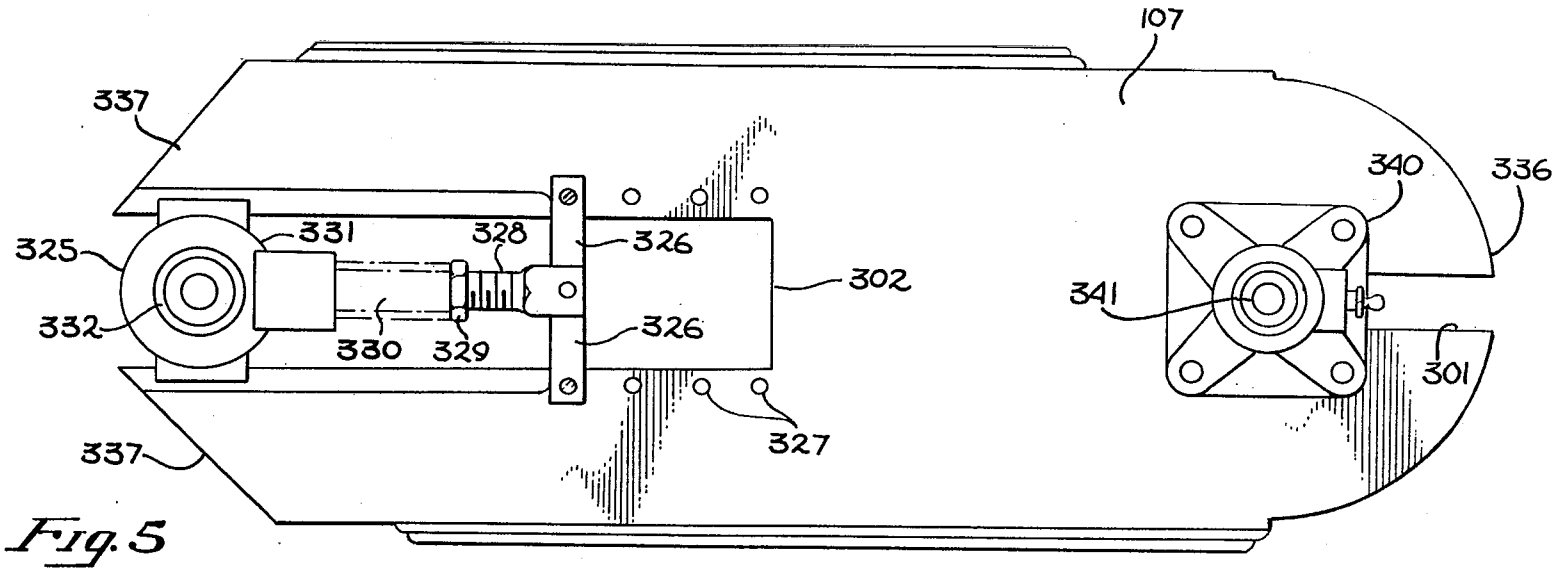
FIG. 5 is a top plane view of the middle plate.

101. These vertical beams or members 104 and 105 are hollow tubular pieces having an approximately square cross-section, however any suitable cross section can be used. The members are located a suitable distance apart near the front edge 102 of the baseplate 101. Two methods are used to give vertical rigidity to each of the vertical members 104 and 105. Firstly, a hollow gusset 106 generally in the shape of a right triangle is positioned so that one leg of the triangle lays along the rear surface of the vertical members 104 and 105, and the other leg lays on the upper surface of the baseplate 101. The gusset is securely affixed in this position to the baseplate and vertical member by an appropriate means, e.g. welding. This supplies vertical rigidity to the vertical members 104 and 105 in the plane of the gussets 106. Secondly, two horizontal structural members, 201 and 202, best illustrated in FIGS. 3*a* and 3*b*, whose cross-section is the same as that of the vertical members 104 and 105, but can be any suitable cross-section, are permanently affixed by means well known in the art to the vertical members 104 and 105 in a horizontal position spanning the space between the vertical members. The lower horizontal member 201 is appropriately spaced above the baseplate 101 and the horizontal member 202 is located approximately at the upper end of the vertical members 104 and 105 and directly above the lower horizontal member 201. These horizontal members give vertical rigidity to the framework of the invention in the plane defined by the horizontal members 201 and 202 and the vertical members 104 and 105. A single plate 203 as shown in FIG. 3a, of a size sufficient to cover the upper ends of the vertical members 104 and 105 and the upper surface of the horizontal member 202, is rigidly affixed by suitable means to the top ends of the vertical members. This plate 203 serves as a base to which is attached, by means well known in the art, a plate which is referred to as the bottom plate 107. This plate 107 is best illustrated in FIG. 5.

The bottom plate 107 is constructed of heavy gauge sheet metal for strength and is generally oblong in shape. The front and rear edges are straight, one end 336 is semicircular in shape and the other is tapered gradually by straight edges 337. Each end of the plate has a rectangular slot extending inwardly from the end along the centerline of the plate. The slot 301 in the semicircular end 336 of the plate is of a width sufficient to accommodate an axle 341 more fully described later. The slot 302 in the tapered end of the plate is of a width and length suitable to accommodate a mechanism well known in the art designed to take up slack in, and adjust the tension on, the drive chain 561. The exact shape of the plate 107 and almost all other members herein described are not critical to this invention, and any member whose shape accomplishes the functional purposes served by the described members are intended to be within the scope and spirit of this invention. Two vertical spacer members 108 and 109, substantially similar in cross-section to the vertical members 104 and 105 earlier described, are suitably positioned and securely affixed to the upper surface 110 of the bottom plate 107 along the centerline of said plate 107. A middle plate 117 is permanently attached to the top end of the vertical members 108 and 109. This middle plate 117 is substantially identical to the bottom plate 107 and disposed directly above the bottom plate such that the similar slots in the two plates are vertically aligned. Two additional vertical spacer members 118 and 119 similar to spacer members 108 and 109 are permanently affixed to the upper surface 120 of the middle plate 117 in the same manner as vertical spacer members 108 and 109 are affixed to the upper surface 110 of the bottom plate 107. An upper plate 127 is suitably affixed to the upper end of the vertical spacers 118 and 119. The upper plate is more fully illustrated in FIG. 4, and is generally oblong in appearance. The upper plate 127 has straight front and back edges, with each end of plate 127 being semicircular in shape. A slight indentation or notch 310 runs along substantially the entire front edge 311 and also runs approximately half way around one end of the palte 127. Affixed to the upper surface 130 of the upper plate 127 are two spacer members 128 and 129, which serve to anchor a guard 1000 over the assembled invention. This guard is more fully illustrated in FIG. 12, and is anchored by suitable means at points 1001.

Attached to the front side of the above described supportive framework is a trough 140 formed of sheet metal and capable of receiving and containing the moving work. This trough 140, shown in FIGS. 1, 2, 3*a* and 3*b*, directs the moving work beneath the blades 803 for cutting. The cross-section of the bottom of the trough is substantially semicircular in shape to accommodate the shape of the work. The trough has a vertical front panel 141 and a vertical rear panel 142 which partially shields the zone in which the cutting is performed, for the purpose of operator safety when the guard 1000 is removed. This trough 140 is supported at a suitable height beneath the cutting blades 803 by rwo brackets 150 and 151. Each bracket has one edge suitably formed so as to follow the contours of the trough 140. The brackets 150 and 151 are made of sheet metal and are affixed to the bottom end of the front surface of the vertical support members 104 and 105, immediately above the baseplate 101. The above description has referred to the basic structural framework of the invention. The following description will refer to the various members which are mounted upon this framework and make up the working elements of the invention.

Figure 6:
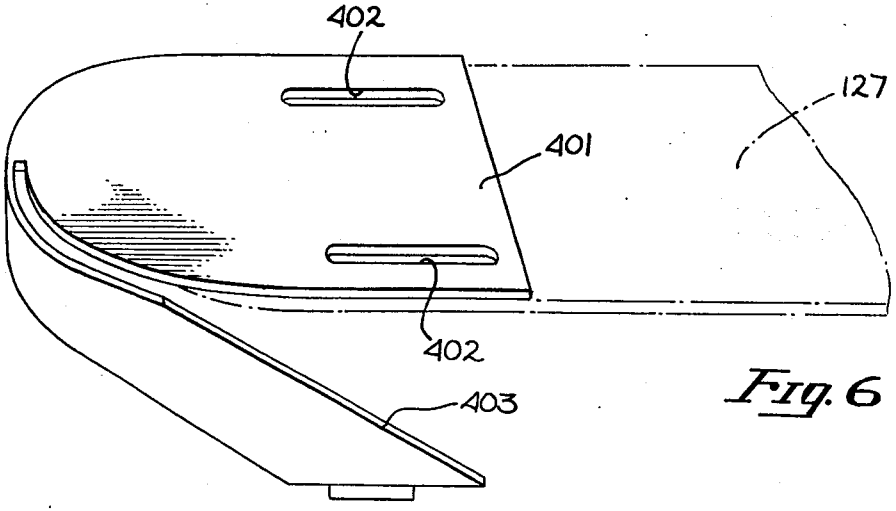
FIG. 6 is an isometric view of the adjustable cam plate.

Two members are mounted on the upper plate 127. The first member is the cam plate 401 illustrated in FIG. 6. The cam plate 401 is mounted on that end of the upper plate 127 which is above the tapered end of the middle plate 117. The complex shaped cam plate has one semicircular side which generally conforms to the semicircular shape of that end of the upper plate 127, but the cam plate does not have the notch 310 present in this end of the upper plate 127. The other three sides of this flat portion of the cam plate are straight edges. This portion of the cam plate is mounted flush against the upper surface 130 of the upper plate 127 by means of bolts which extend through two parallel slots 402 of equal length, cut through the cam plate 301, to threaded holes in the upper plate 127. By loosening the bolts, the position of the cam plate can be adjusted in or out relative to the center of the upper plate 127 in order to accommodate shorter or longer chains. A partially curved partially straight ramp 403 extends from the semicircular portion of the cam plate 401 through the notch 310 in the upper plate 127 downward to the guide rail 565 on the front edge of the middle plate 117. The knives of this invention are forced to travel up this ramp 403, from the guide rail 565 on the front edge of the middle plate to the upper surface of the cam plate 401, after the knives have made their repspective cuts in the moving work.

The second member mounted on the upper plate 127 is the wedge plate 501 shown in FIG. 7. This a metal plate generally in the shape of a right triangle. The plate 501 is mounted on the front edge 311 of the upper plate 127 near the other end of the notch 310. The longer leg 503 of the plate 501 being parallel with the upper plate and positioned slightly above the level of plate 127. The hypotenuse 502 of the wedge plate 501 extends from the vicinity of the notch 310 in the front edge 311 of plate 127 downward toward the guide rail 565 of the middle plate 117. The hypotenuse 502 serves as a guide member for the roller bearings 805 attached to the top end of the knives. When the roller bearing 805 encounters the guide member 502 the roller bearing 805 is forced along the guide member in a downward and forward direction thus forcing the blade 803 to cut the moving work.

The middle plate 117 and bottom plate 107 are very similar to each other and serve as mounts for the sprocket wheels 505 and 506. The plates 117 and 107 also have guide rails 565 and 566 mounted on their respective front edges, as indicated above, and each plate also has a means for taking up slack in the chains mounted onto the plate. Each of these members is described below. The guide rail 565 which runs along the front edge of the middle plate 117 is a thin metal strip, one side of which is fastened to the front edge of the plate 117, extending above and below the plate. The part of the guide rail 565 that extends above the plate 117 serves as a guide for the roller bearing 805 at the top of the knife after the knife has made its cut in the moving work. That part of the guide rail 565 that extends beneath the middle plate 117 serves as a guide rail for the roller bearings at the upper end of the knife holder 601, shown in FIGS. 8 and 11.

The guide rail 566, similiarly mounted on the front edge of the lower plate 107, extends above plate 107 and serves as a guide rail for the roller bearings mounted at the lower end of the knife holder 601, thereby lending vertical rigidity to the knife holder during the time that it supplies power to the invention apparatus.

As previously described, both the middle plate 117 and the lower plate 107 have rectangular slots extending inward from the tapered end of the plate, along the centerline of the plates, toward the center of each plate. Within each such slot is mounted an adjustable spring operated mechanism generally indicated in FIG. 5 at 325 for eliminating slack in the chains. The mechanism consists of a base element, 326, which can be anchored at various locations 327 along the slots by means of bolts, a threaded shaft 328, and an adjusting nut 329 which when moved up or down the threaded shaft 328 varies the tension of the spring 330 which is connected to the collar 331 which houses the axle 332 upon which the sprocket wheel 505 is mounted. By changing the location of the base element 326 and adjusting the position of the nut 329, tension is transmitted to the axle 332, forcing it outward and taking up the slack in the chains. Mechanisms such as this, for taking up slack are commonly known in the industry, and any similarly suitable mechanism can be used in this invention.

Mounted in the slot at the other end of each of the plates 107 and 117 is a flange bearing 340. An axle 341 is mounted in the bearings 340 attached to the plates 107 and 117. A sprocket wheel assembly 506 is suitably mounted on this axle 341. The sprocket wheel assembly 506 is essentially the same as sprocket assembly 505 mounted on axle 332. The sprocket wheel assemblies 505 and 506 consist of two identical sprocket wheels 550 mounted on either end of a hollow cylindrical shaft 551 which fits over the axle 341 and 332. When the sprocket wheel assemblies 505 and 506 are properly mounted, between plates 107 and 117, the two upper sprocket wheels will be in the same horizontal plane and the two lower sprocket wheels will be in another horizontal plane. A flexible force transmitting means, such as the continuous chain 560, is mounted upon the two upper sprocket wheels and another chain 561 is mounted upon the two lower sprocket wheels. These sprocket wheel assemblies are best illustrated in FIG. 7.

At equal intervals around the length of the flexible force transmitting means, or chains, are mounted a plurality of knife holders, 601 shown in FIGS. 8 and 11. One end of the knife holder is fastened to the upper chain 560 and the other end is fastened to the lower chain 561 so that the knife holder is vertically oriented. This fastening method supplies the necessary vertical rigidity to the knife 801 mounted within the knife holder 601. The combination of a cutting means (typically a knife 801) and its mounting (typically a knife holder 601) is referred to as a cutting means assembly. The knife holders have various cylindrical roller bearings 930 mounted upon them which serve to guide the knife holder 601 along the guide rails 565 and 566. Other bearings 931 serve to secure the knife 801 and yet allow vertical movement of the knife with respect to the knife holder 601. The knife 801 consists of a blade holder 802 and a blade 803 as shown in FIG. 9. The blade holder 802 is a solid metal shaft with a roller bearing 805 attached near the top end. The other end of the shaft is shaped like a squared letter C with the open side facing downward and the opposite straight portion joined at its midpoint to the straight portion of the blade holder. The roller bearing 805 mounted at the top of the blade holder 802 extends outward from the blade holder in the same plane as that portion of the holder shaped like the squared letter C. The general shape of this blade holder is therefore similar to the inverted capital letter Y. The blade itself, 803, can be generally described as a rectangular plate having one semicircular side which is the cutting edge 808. In an alternate embodiment, the cutting of the blade 803 could be formed so as to consist of two semicircular protrusions. Each edge of the double edged blade would have moving work directed beneath the blade for cutting, and thus with a single stroke of the knife, one cut could be made in each of two parallel extrusions of moving work. A final element, the stripper 810, is rigidly attached to the knife holder 601. The stripper shown in FIG. 10, is a rectangular metal strip with a notch 811 cut into one side. This notch 811 is sized and located so as to assure that the stripper does not strike the upper guide rail 565. One end of the stripper is firmly affixed to the knife holder 601 and mounted such that the plane of the stripper 810 is parallel to and behind the plane of the blade 803. The moving work exhibits a tendency to adhere to the blades 803 after being cut, the adhering work rises up from the trough until it strikes the stripper thereby dislodging itself from the blade and falls back into the trough 140. The entire apparatus is covered by a guard 1000 illustrated in FIG. 12.

With the above detailed description of the individual parts in mind, the operation of the invention will be more easily understood.

OPERATIONAL DESCRIPTION

Since this invention draws its operating power from the moving work itself, it is essential for the operation of the invention that at least one blade 803 be in contact with the moving work at all times.

As a necessary result of the physical construction of the invention, at least one blade will always extend into the path of the moving work. The operation begins when the moving work, proceeding down the trough 140 encounters that blade which extends into its path. As the work continues to move it exerts a force against this blade causing it to move forward. The direction in which the blade is pushed will be referred to herein as the forward direction, the opposite direction is referred to as the backward direction. The force exerted on the blade is transmitted up the shaft of the blade holder, through the knife roller bearings 931 to the knife holder 601 and to the chains, causing the chains to revolve. This movement of the chain transmits the force backward along the chain pulling the next blade into cutting position.

As might be expected, there are significant frictional forces present in this apparatus. The sum total of these frictional forces is that force which must be applied to the cutting blade to cause the chains to rotate. These frictional forces produce an unexpected advantageous result upon the work. The moving work exerts a force on the blades, and the blades exert an equal and opposite force upon the moving work. These equal and opposite forces compress and compact the moving work, producing a final cut artificial log of more uniform density than achieved by mere extrusion of the work. The degree of compaction is determined by the temperature of the work and the total friction in the apparatus. The total friction can be adjusted, within limits, by varying among other things, the slope of the ramp 403 of the cam plate 401 and the slope of guide member 502 of the wedge plate 501.

The operation is best illustrated by a step by step description of the path which is followed by the roller bearing 805 located at the top of the knife.

a. When a knife is being pushed forward and thus supplying power to the apparatus as explained above the roller bearing at its upper end is traveling forward along the guide rail 565 attached to the front edge of the middle plate 117. As this first knife moves forward the next knife backward along the chain is being pulled forward. The roller bearing at the top of this second knife is in contact with the outer perimeter of the top surface of the upper plate 127, traveling forward toward the notch 310 in the upper plate.

b. As the first knife proceeds further along the guide rail 565, the second knife is pulled forward and its roller bearing falls off the upper plate when it reaches the notch 310, and encounters the downward directed guide member 502 of the wedge plate 501. The roller bearing follows the guide member 502 downward causing the second knife to be forced downward, thus cutting the moving work, at the same time that it is being pulled forward by the first knife.

c. As the second knife cuts deeper into the moving work, it becomes the knife which supplies power to the apparatus, since now the moving work is pushing against the back surface of this blade.

d. As the first knife proceeds forward the roller bearing at its upper end encounters the upward directed ramp 403 of the cam plate 401 and travels up this ramp until it eaches the upper surface of the upper plate 127. This lifts the knife out of the path of the moving work.

e. The roller bearing of the second knife has now reached the guide rail 565 of the middle plate 117 and from this point it performs the functions of the first blade outlined above and pulls a third knife into cutting position.

f. The roller bearing at the top of the first knife proceeds to travel around the outer perimeter of the top surface of the upper plate 127 until it in turn encounters the downward directed guide member 502 of the wedge plate 501. This cycle continues so long as there is moving work pressing against the back surface of any blade.

Various additional changes and modifications in the above described apparatus and the method of operation thereof will be readily apparent to one skilled in the art and such changes and modifications are deemed to be within the spirit and scope of the present invention as set forth in the following appended claims.

What is claimed is:

1. A mechanical apparatus for cutting moving work wherein the energy used to power the apparatus is obtained from the moving work by means of a mechanical linkage, said apparatus being comprised of:

a supportive framework and mounting means;

one or more force transmitting means suitably mounted upon said supportive framework on said mounting means so as to be freely rotatable thereon;

a plurality of cutting means assemblies mounted at intervals upon said force transmitting means, the cutting member of said asembly being slidably moveable therein, with the vertical position of each cutting member being controlled by application of a force to the top of each cutting member;

a cam member placed in the path of the cutting member at a first station such that when the cutting member encounters the cam an upward force is exerted upon the cutting member thus moving the cutting member from a lower position to a higher position and moving the cutting member out of the path of the moving work;

a guide member located in the path of the cutting member at a second station such that when the cutting member encounters the guide member a downward force is exerted upon the cutting member thereby causing the cutting member to move from its raised position to its lowered position and sever the moving work;

a work guiding means which guides the moving work along a path such that the moving work encounters a first cutting member in its lowered position, thereby exerting a force upon said first cutting member which force is transmitted through the cutting means assembly and along the force transmitting means to a second cutting member as this second cutting member encounters the guide means at the second station and moves from its raised to its lowered position, said second cutting member thereby simultaneously severing the moving work and assuming the role of said prior first cutting member.

2. An apparatus according to claim 1 wherein the position of the cam member and the position of the mounting means of the force transmitting means are adjustable so as to accommodate different lengths of force transmitting means.

3. An apparatus according to claim 2 in which the force transmitting means is a flexible force transmitting means.

4. An apparatus according to claim 3 wherein the flexible force transmitting means consists of a plurality of chains.

5. An apparatus according to claim 1 wherein the cutting member consists of a blade mounted on one end of a blade holder with a roller bearing attached to the other end of the blade holder.

6. An apparatus according to claim 1 wherein the guide member, located in the path of the cutting member at the second station, exerts a downward force upon the roller bearing of said cutting member when said cutting member encounters the guide member, thereby causing the cutting member to move from its raised position to its lowered position and sever the moving work.

7. An apparatus according to claim 1 wherein the work guiding means is an open ended trough.

8. An apparatus according to claim 1 wherein the force transmitting means is a flexible force transmitting means.

9. An apparatus according to claim 3 wherein the cutting member consists of a blade mounted on one end of a blade holder with a roller bearing attached to the other end of the blade holder.

10. A mechanical apparatus designed to cut moving work which defines the path followed by a plurality of roller bearings thereby determining the motion of the cutting knives attached to each of said bearings, said mechanical apparatus comprising:

a flexible force transmitting means which defines the horizontal limits of the path followed by the roller bearings, and which transmits the power from one knife to a second knife thereby pulling said second knife forward;

a guide rail member which defines the lower portion of the path followed by the roller bearings during the time the knife is being pushed forward by the moving work and transmitting power to the apparatus;

an adjustably located cam plate extending from the lower path as described above to an upper path such that when the roller bearing encounters the cam plate, an upward force is exerted upon the roller bearing thereby lifting the roller bearing up the cam plate to the upper path level and also raising the knife out of the path of the moving work;

an upper level path defined by the outer perimeter of the upper surface of a plate of suitable material, said upper path terminating at a notch in said plate which notch allows the roller bearings to roll off the upper path as they fall through the notch;

a wedge plate guide member located in the path followed by the roller bearings as they roll off the upper path level, said wedge plate member defining the transition path followed by the roller bearings from the upper path level to the lower path level as defined above;

a plurality of cutting knives suitably mounted with a plurality of knife holders, upon a flexible force transmitting means such that the knife periodically extends into the path of moving work and is thereby pushed by the moving work imparting motion and power to the apparatus.

* * * * *